United States Patent [19]

Carney

[11] Patent Number: 4,461,216

[45] Date of Patent: Jul. 24, 1984

[54] OVER AND UNDER ACCUMULATING POWER AND FREE CONVEYOR SYSTEM

[75] Inventor: Edward J. Carney, Bloomfield Hills, Mich.

[73] Assignee: Acco Babcock Inc., Fairfield, Conn.

[21] Appl. No.: 425,450

[22] Filed: Sep. 28, 1982

[51] Int. Cl.[3] ..... B61B 10/02

[52] U.S. Cl. ..... 104/172 B; 104/89; 104/172 S; 198/472

[58] Field of Search ..... 104/89, 94, 172 B, 172 R, 104/172 C, 172 S; 198/472, 473

[56] References Cited

U.S. PATENT DOCUMENTS 2,898,101 8/1959 Hannum et al. ..... 198/472 X 4,031,829 6/1977 Bell et al. ..... 104/172 C X

*Primary Examiner*—Randolph Reese

*Assistant Examiner*—Gregory A. Beehner

*Attorney, Agent, or Firm*—Barnes, Kisselle, Raisch, Choate, Whittemore & Hulbert

[57] ABSTRACT

A power and free conveyor system comprising a plurality of carriers, a carrier track comprising an upper run, a lower run, and connecting portions connecting the upper and lower runs, such that the carriers can be moved along the upper run and thereafter through a first connecting portion along the lower run in inverted position and returned to the upper run through a second connecting portion. A powered conveyor is associated with the upper and lower runs and connecting portions and has pushers thereon for engaging the carriers. Each carrier has a first pusher dog thereon movable downwardly when the carrier moves along the upper run for engagement with a pusher of the conveyor and movable upwardly when the carrier is moving along the lower run so that it is out of engagement with the pusher of the conveyor. Each carrier has a second pusher dog thereon which is normally out of engagement with the pusher of the conveyor when the carrier is moved along the upper run and is moved into engagement with the pusher of the conveyor when the carrier is moved along the lower run. Each carrier pusher dog is operable upon engagement with an obstacle for movement out of engagement with the pusher of the conveyor.

8 Claims, 9 Drawing Figures

OVER AND UNDER ACCUMULATING POWER AND FREE CONVEYOR SYSTEM

This invention relates to power and free conveyors.

BACKGROUND AND SUMMARY OF THE INVENTION

In one type of power and free conveyor system, the carriers are moved along a track and are adapted to be interengaged by pushers of a conveyor. It is often desirable that the carriers moving along a portion of the track be able to accumulate when they encounter a preceding carrier, an obstacle or a stop. In such conveyor systems, the carriers are returned to their original position for reuse and it is also desirable to be able to accumulate the carriers during their return as well. In one type of system, carriers are moved along an upper run of a track and returned along a lower run. Accumulation is achieved by spring pusher dogs which are difficult to adjust and maintain.

Accordingly, among the objectives of the present invention are to provide a power and free conveyor system wherein accumulation can be achieved both during the carrying portion of a track and the return portion of the track; which system is relatively simple and inexpensive to manufacture and maintain; which does not require adjustment; which will not get out of adjustment; which does not require springs, wherein the accumulation is not affected by the weight of the load and which has minimal wear.

In accordance with the invention, each carrier has a first pusher dog thereon movable downwardly when the carrier moves along the upper run for engagement with a pusher of a conveyor, and movable out of engagement with the pusher of the conveyor when the carrier moves along the lower run. The carrier has a second pusher dog thereon which is normally out of engagement with the pusher of the conveyor when the carrier is moved along the upper run and is moved into engagement with the pusher of the conveyor when the carrier is moved along the lower run. Each dog is operable upon engagement with an obstacle for movement out of engagement with the pusher of the first conveyor.

DESCRIPTION

Figure 1:
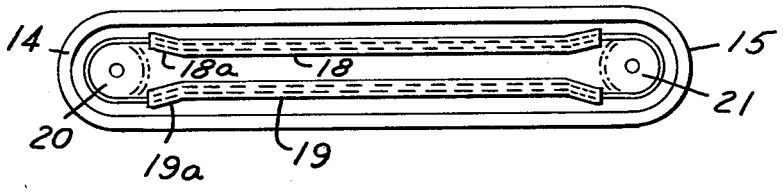
FIG. 1 is a partly diagrammatic elevational view of a system embodying the invention.
Figure 5:
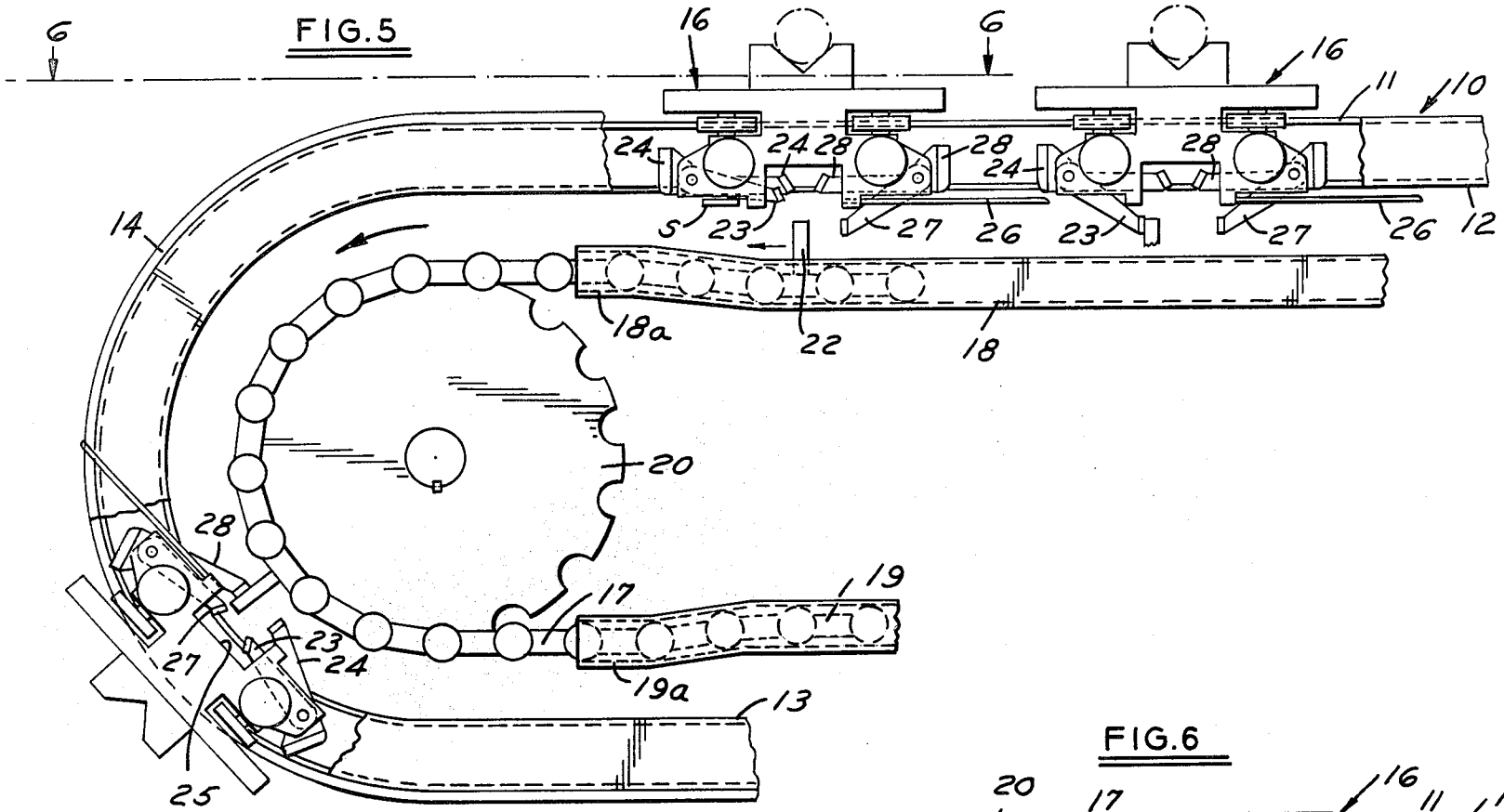
FIG. 5 is a fragmentary view on an enlarged scale of a portion of the system shown in FIG. 1.
Figure 6:
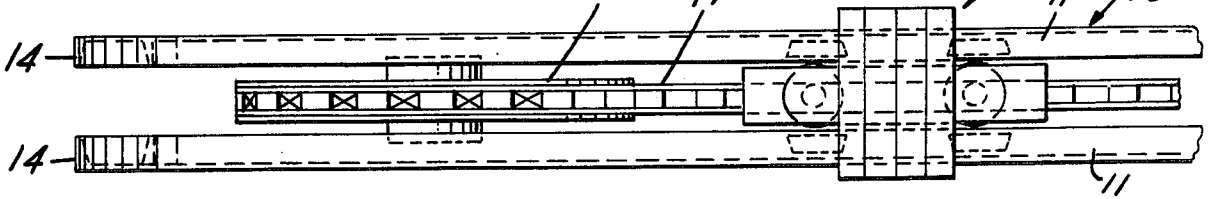
FIG. 6 is a fragmentary plan view of the system taken along the line 6—6 in FIG. 5.
Figures 7, 8:
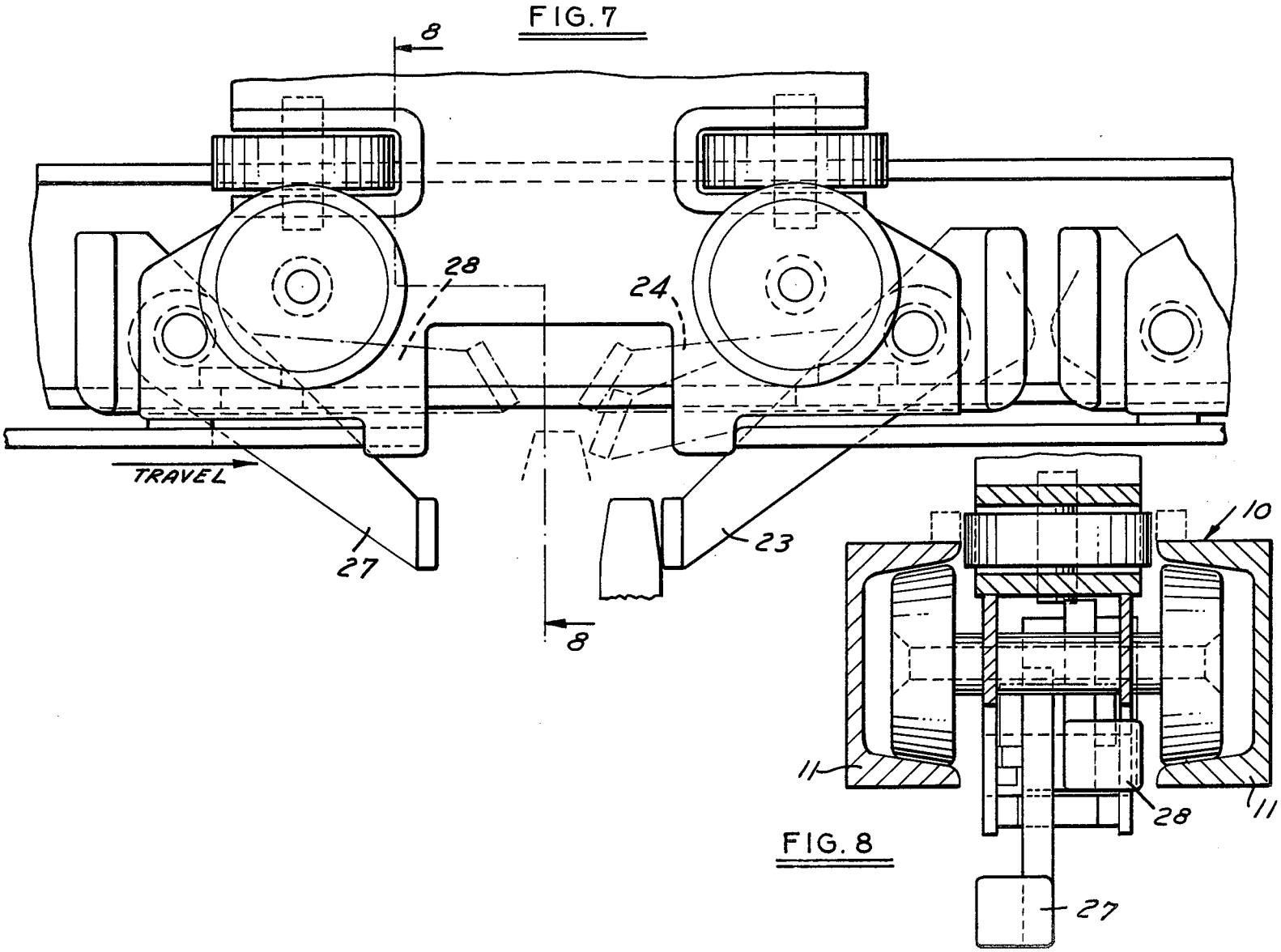
FIG. 7 is a fragmentary view of a portion of the system shown in FIGS. 1, 5 and 6 on an enlarged scale.
FIG. 8 is a fragmentary sectional view taken along the line 8—8 in FIG. 7.

Referring to FIGS. 1 and 5, the power and free conveyor system embodying the invention comprises a track 10 that includes inwardly facing spaced channel members 11. The track 10 includes an upper run 12, a lower run 13 and connecting curved intermediate portions 14, 15.

A plurality of free wheeled carriers 16 are provided for movement along the track 10 and are adapted to be moved, as presently described along the upper run 12 and along the lower run 13. Thus the carriers 16 move from an upright position on the upper run 12 to an inverted position along the lower run 13.

As further shown in FIG. 1, a conveyor 17 is moved along a conveyor track which has an upper conveyor track 18 extending below the upper run 12 of the carrier track 10, a lower conveyor track 19 extending above the lower run 13 of the carrier track and is trained over guides such as sprockets 20, 21 extending, respectively, along the connecting portions 14, 15 of the carrier track 10. Conveyor 17 includes spaced pushers 22.

In order that carriers 16 can be pushed along both the upper run 12 and the lower run 13, each carrier 16 is provided with two pusher dogs 23, 24. A first dog 23 extends downwardly into the path of the pusher 22 when the carrier is on the upper run 12 and a second dog 24 which extends upwardly into the path of the pusher 22 when the carrier is inverted and moved along the lower run 13. More specifically, the first pusher dog 23 extends downwardly when the carrier 16 is along the upper run 12 while the second pusher dog 24 is counterweighted out of engagement with the pusher 22 when the carrier 16 is on the upper run 12. When the carrier 16 is moved beyond the curved portion 14 and along the lower run 13, the counterweighted second dog 24 is pivoted up into the path of the downwardly extending pushers 22 while the first dog 23 falls downwardly out of the path of the pusher 22. As shown, the dogs are mounted on a single axis. The carrier 16 is further provided with stabilizing wheels that rotate about vertical axes and extend between the flanges of the track portions.

In order to insure the movement and control of the carriers about the curved portions, the track portions are so positioned that the pusher 22 of the conveyor 17 is moved closer to the carriers 16 along the curved portions 14, 15 such that the pusher 22 engages in indentation or recess 25 in the body 26 of the carrier 16 to moveand control the carrier 16 about the curved portions 14, 15. The normal distance between the carrier track 16 and conveyor track 18, 19 is re-established after passing about the sprockets 20, 21. The ends **18*a*, 18*b* of conveyor track 18 and the ends 19*a*, 19*b* of conveyor track 19 are bent to guide the conveyor 17 during the change of spacing relative to the carrier track 16**.

In order that the carriers 16 may be accumulated upon encountering a preceding carrier or an obstacle or a stop, each carrier 16 is provided so that the mechanism by which it is pushed is disengaged and moved out of the path of a pusher. More specifically, the pusher dogs 23, 24 are pivoted to the carrier body such that if they are in operative position and encounter an obstacle or a stop or a projection 26 of a preceding carrier, the pusher dog is tilted out of the path of a pusher 22.

Each carrier is further provided with a pair of hold back dogs 27, 28 associated with the respective pusher dogs 23, 24. Hold back dog 28 is counterweighted so that it is out of the path of a pusher 22 when the carrier 16 is on the upper run 12 and in the path of the pusher 22 when the carrier is on the lower run 13.

Figure 2:
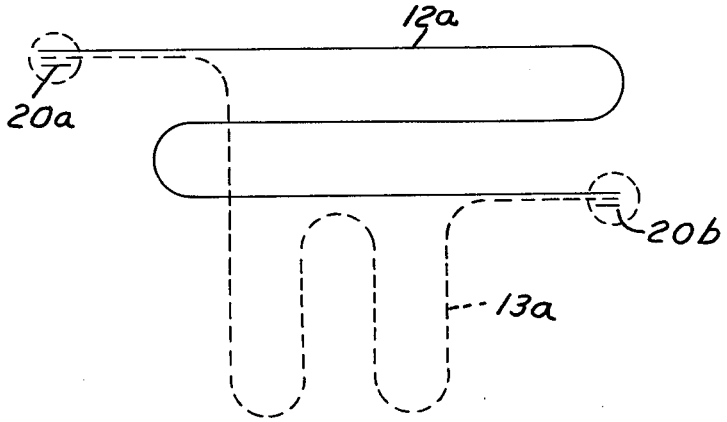
FIG. 2 is a diagrammatic plan view of a modified system.

As shown in FIG. 1, the upper run and lower run are straight. However, they may take a circuitous route as shown, for example, in FIG. 2 wherein the upper run 12*a* follows a different path than the lower run 13*a*.

Figure 3:
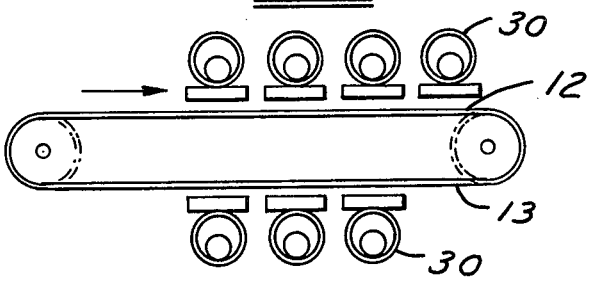
FIG. 3 is a diagrammatic view of a further modified view.
Figure 4:
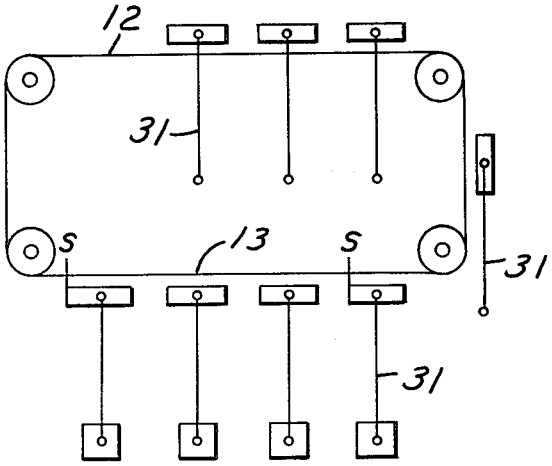
FIG. 4 is a diagrammatic view of another modified form.

The load is shown as being carried by the carriers on the upper run 12*a* but can be carried on the lower run also as in FIG. 3, provided that the load is properly fixed or supported on the carriers by retainers 30. As shown diagrammatically in FIG. 4, the load can be suspended from the carriers by hangers 31.

Figure 9:
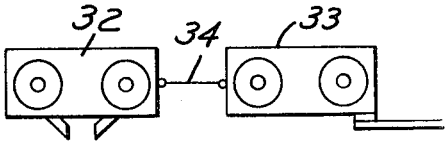
FIG. 9 is a diagrammatic view of a modified form of carrier.

Although the carriers have been shown as comprising a single trolley, the carriers can comprise multiple trolleys 32, 33 connected by a tie bar 34. (FIG. 9)

I claim:

1. A power and free conveyor system comprising a plurality of carriers, a carrier track comprising an upper run, a lower run, and connecting portions connecting the upper and lower runs, such that the carriers can be moved along the upper run and thereafter through a first connecting portion along the lower run in inverted position and returned through a second connecting portion to the upper run, conveyor means associated with the upper run, the lower run and the connecting portions and having pushers therein, each said carrier having a first pusher dog thereon movable downwardly when the carrier moves along the upper run for engagement with a pusher of the conveyor means, said first dog being operable when the carrier is moving along the lower run so that it is out of engagement with a pusher of the conveyor means, said carrier having a second pusher dog thereon which is normally out of engagement with the pusher of the conveyor means when the carrier is moved along the upper run and is moved into engagement with the pusher of the conveyor means when the carrier is moved along the lower run.

2. The conveyor system set forth in claim 1 wherein each said dog is operable upon engagement with an obstacle for movement out of engagement with a pusher of the conveyor means.

3. The conveyor system set forth in claim 1 wherein said second dog has a counterweight operable to urge the second dog out of engagement with the pusher of the conveyor means when the carrier is on the upper run and operable to bias the second dog into engagement with a pusher of the conveyor means when the carrier is on the lower run.

4. The conveyor system set forth in claim 1 wherein said conveyor means comprise a single conveyor movable generally parallel along said track beneath the upper run, along the intermediate portions and above the lower run.

5. The conveyor system set forth in claim 4 wherein said conveyor along said intermediate portion connecting said upper and lower runs of said carrier track is positioned such that the pushers thereon are closer to said carriers, and interengaging means between said carriers and said pushers for guiding and moving the carriers between said runs.

6. The conveyor system set forth in claim 5 wherein said interengaging means comprises an indentation in the body of each said carrier into which the pusher of the conveyor extends.

7. The conveyor system set forth in claim 1 including a hold back dog on each said carrier individual to said first pusher dog and said second pusher dog and movable into and out of operative position with respect to a pusher in a manner corresponding to its respective pusher dog.

8. The conveyor system set forth in claim 7 wherein each of said dogs is mounted for tilting movement.

* * * * *